United States Patent [19]

Peterson

[11] Patent Number: 5,032,062

[45] Date of Patent: Jul. 16, 1991

[54] COMPRESSOR DEMAND CONTROL SYSTEM FOR LONG TERM COMPRESSOR OPERATION

[75] Inventor: Clyde O. Peterson, Plum Borough, Pa.

[73] Assignee: Westinghouse Electric Corp., Pittsburgh, Pa.

[21] Appl. No.: 457,049

[22] Filed: Dec. 26, 1989

[51] Int. Cl.[5] ..... F04B 49/00

[52] U.S. Cl. ..... 417/282; 417/295; 417/310

[58] Field of Search ..... 417/282, 295, 300, 310; 415/17

[56] References Cited

U.S. PATENT DOCUMENTS 3,380,650 4/1968 Drummond et al. .
3,535,053 10/1970 Jednacz .
3,778,695 12/1973 Bauer Jr. .
3,863,110 1/1975 Bauer Jr. .
4,080,110 3/1978 Szymaszek .
4,191,511 3/1980 Stewart et al. .
4,462,217 7/1984 Fehr .
4,519,748 5/1985 Murphy et al. .

*Primary Examiner*—Leonard E. Smith
*Assistant Examiner*—David W. Scheuermann
*Attorney, Agent, or Firm*—C. M. Lorin

[57] ABSTRACT

In a compressor control system, surge upon a sharp demand for lower airflow is avoided by placing an offset value above the minimum airflow absolute limit. When reaching downward under inlet valve modulation such offset limit, the master-controller initiates bypass valve modulation and a subcontroller brings the inlet valve from the offset limit down to the absolute minimum airflow position. Provision is made against exceeding the offset limits during such excessive demand downward by imposing a limit to the inlet valve position command. Upon a return upward toward normal operation, provision is made against an intervening and sudden downward demand by imposing a limit to the inlet valve position command representing the minimum airflow operation.

7 Claims, 7 Drawing Sheets

COMPRESSOR DEMAND CONTROL SYSTEM FOR LONG TERM COMPRESSOR OPERATION

CROSS-REFERENCED COPENDING PATENT APPLICATION

The present invention is related to the invention disclosed in copending patent application Ser. No. 457,046, filed on Dec. 26, 1989 (W.E. 54,815) by the same Applicant and entitled "Long Term Compressor Control Apparatus". The cross-referenced Patent Application is hereby incorporated by reference.

BACKGROUND OF THE INVENTION

The invention relates to compressor control in general, and more particularly to compressor control operative on the long term while preventing the occurrence of a surge upon any intervening demand for a substantial load reduction.

It is known to adjust the flow of fluid in a compressor by controlling successively the inlet valve and the bypass valve of the compressor. To this effect, a master-controller has been associated with the compressor control system imposing a pressure setpoint and receiving a pressure feedback. As shown in U.S. Pat. No. 3,380,650, the inlet valve is controlled downward only to a minimum positioning level, in order to avoid a nonsteady situation which would cause a surge. This limit has been called the surge point. It is also known from this patent to recognize such minimum positioning of the inlet valve by sensing a minimum horse power from the motor driving the compressor. Such minimum positioning, however, is not maintained by the system. It has been proposed in the cross-referenced patent application, while controlling the bypass valve, to automatically maintain the inlet valve at its minimum position, while using the current of the motor driving the compressor as an indicator of any deviation from the assigned minimum inlet valve position. It is now proposed to reach such minimum inlet valve position upon a sharp demand for lower pressure without exceeding the minimum.

A surge is known to occur in a centrifugal compressor when the back pressure of the load becomes greater than the compressor pressure. It is known to prevent such occurrence by using a blow-off, or bypass valve, to vent the compressor when the flow falls below a preset minimum. See for instance U.S. Pat. No. 3,863,110.

It is recognized that for continuous operation a minimum flow rate should at all time be maintained in order for the compressor to be ready to supply the new demand following a fall of the demand. Such minimum flow rate could be exceeded should the master-controller receive an extreme and sharp demand for control of the pressure. The object of the present invention is to provide a reliable minimum flow rate despite an abrupt fall of the demand. Such an approach insures continuous operation of a compressor system under extreme load demands without any risk of a surge.

SUMMARY OF THE INVENTION

The invention resides in a compressor control system including: an inlet valve and a bypass valve associated with a compressor powered by a constant speed electrical motor for supplying a constant flow of fluid to a load having an instantaneous operative pressure thereunder; and a master-controller for modulating said inlet and bypass valves, one at a time, in response to such load pressure for adjusting the same. The compressor system is assigned a minimum inlet valve limit position such that there be a minimum air flow from the inlet valve through the compressor, such limit position being defined as a minimum inlet valve position never to be exceeded in order to avoid surging.

According to the present invention, control of the bypass valve to further decrease (a mode hereinafter referred to as the "downward mode") the compressor flow and reduce the output pressure is initiated by the master-controller in relation to an offset inlet valve position, rather than the intended minimum inlet valve position. Therefore, upon such offset position of the inlet valve being reached, control of the bypass valve is initiated, while a subcontroller, associated with the master-controller, brings progressively and safely the inlet valve to the intended minimum valve position. When the system returns toward inlet valve control by closing the bypass valve so as to increase the operative pressure (a mode referred to hereinafter as the "upward mode"), once the bypass valve has closed, the inlet is first opened beyond its assigned minimum inlet valve position, and when the valve has reached the said offset position, the master-controller is placed under assignment not to exceed said offset inlet valve position, whatever the demand of the system. The offset valve position is chosen such that control operation in the downward mode will never exceed said assigned minimum inlet valve limit position. The inlet valve position is derived by sensing the current of the motor driving the compressor, and such sensed motor current magnitude is compared with a first minimum current reference signal used as a first reference to indicate when said offset inlet valve position has been reached, then, a second current reference signal is used still in the downward mode as a reference for zeroing toward the assigned minimum inlet valve position. The inlet valve absolute minimum position will be reached while controlling the bypass valve. The second current reference is used as a threshold to detect actual transfer of the system operation to the upward mode, and automatically the first current reference is re-established for the downward mode.

DESCRIPTION OF THE PREFERRED EMBODIMENT OF THE INVENTION

Figure 1:
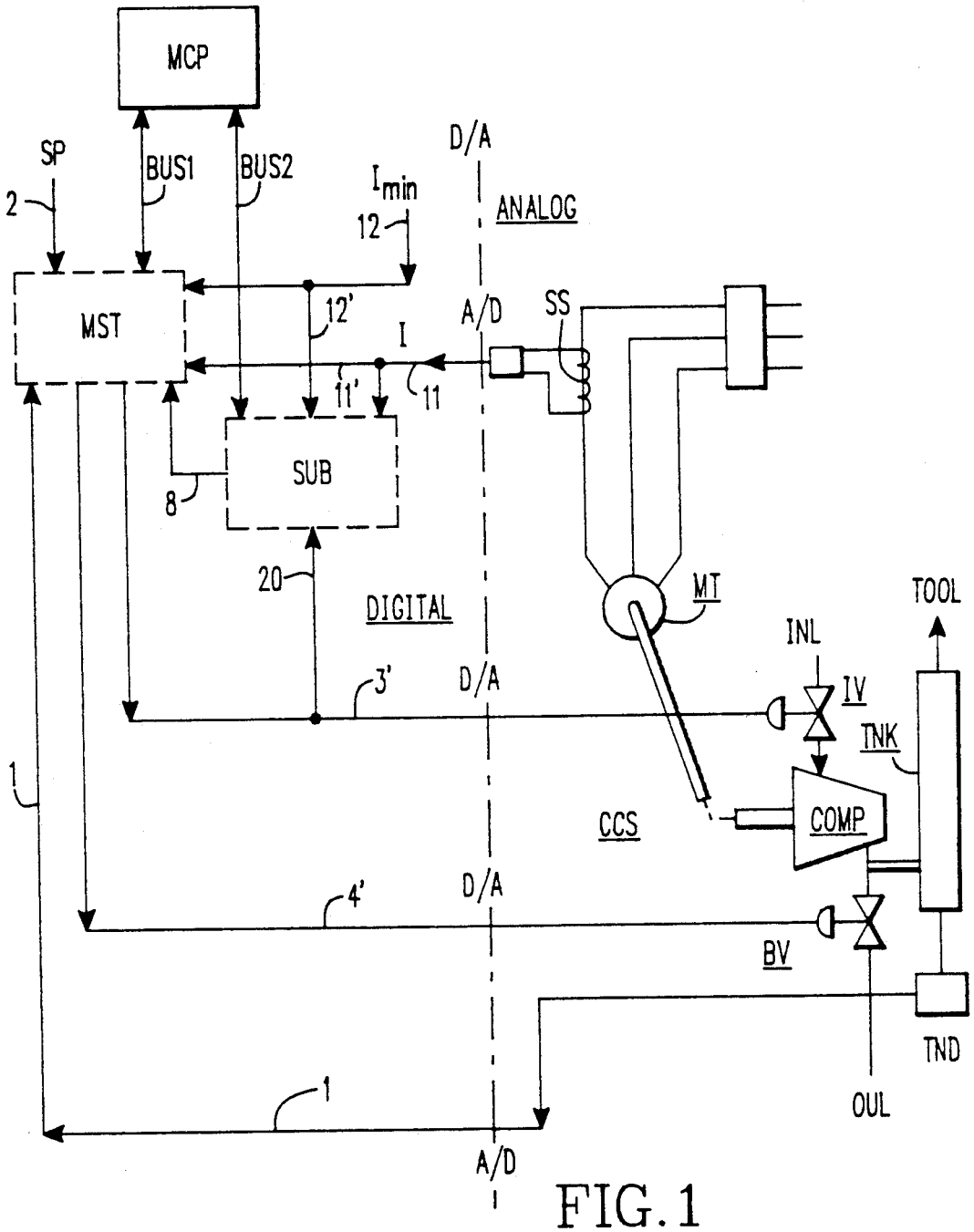
FIG. 1 is a block diagram of the compressor control system according to the invention.

Referring to FIG. 1, the compressor control system according to the invention is shown to include a compressor COMP controlled by a master-controller MST responsive to a sub- controller SUB, the latter being like the one shown in the cross-referenced and incorporated-by-reference patent application. The master-controller and the subcontroller, as illustrated, are under monitoring and control of a microprocessor MCP (for instance, an INTEL 8031). The master-controller provides control for the inlet valve IV (on line 3'), or for the bypass valve BV (on line 4') of the compressor, in accordance with a setpoint pressure (applied on line 2) and a feedback pressure signal (derived on line 1) from a transducer TND associated with the tank TNK which is energizing a tool and is supplied with air from the compressor through a check valve CV. The subcontroller derives on line 20 a present command for the inlet valve position IV, and generates a corrected value on line 8 which is supplied instead to the master-controller. The current I of the motor MT driving the compressor (at constant speed for constant airflow) is sensed and applied on line 11 to the master-controller and on line 11' to the subcontroller.

Figure 2:
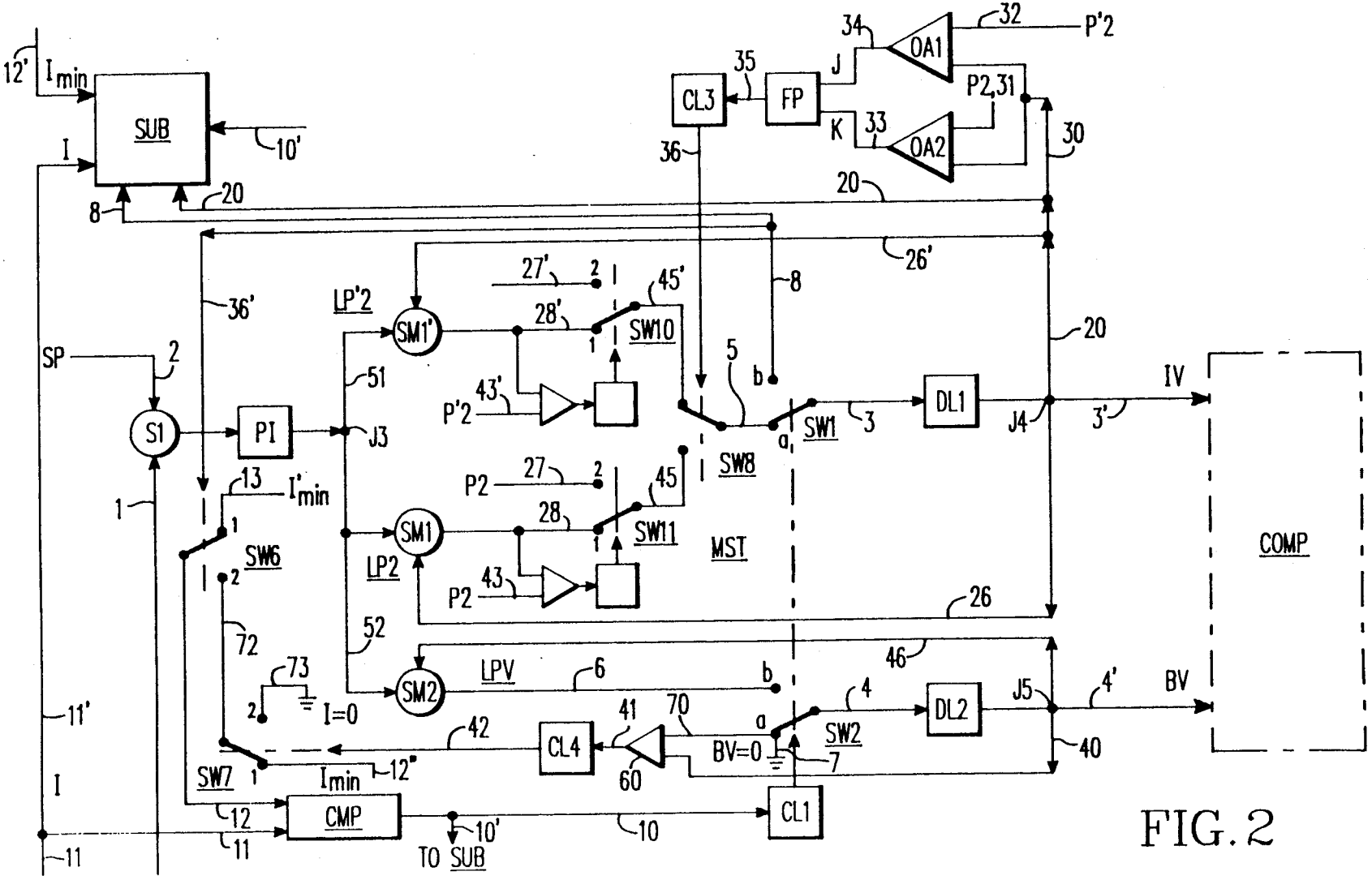
FIG. 2 shows the preferred embodiment of the master-controller of FIG. 1 for surge avoidance according to the present invention.

Referring to FIG. 2, the master-controller MST differs from the master-controller described in the cross-referenced patent application in several respects, as explained hereinafter. As a matter of introduction, instead of a single inlet valve control loop extending from junction J3 to position a of switch SW1, there are two of them, namely LP2' and LP2. Loop LP2' involves an offset limit P2' applied as a reference on line 27' to position 2 of a switch SW10, and to a comparator by line 43. Loop LP2' responds by line 51' to junction J3 from the proportional plus integral loop PI derived from subtractor S1. Line 51' applies the error ΔIV from junction J3 to a summer SM1' also receiving by line 26' the last inlet position (IV) from junction J4 behind delay DL1. Summer SM1' outputs on line 28' the compensated value IV+ΔIV which, over switch SW10 in position 1, provides by line 5 and line 3 (over switch SW1 in position a for IV valve modulation) the new value required for the inlet valve on line 3', after the delay DL1. Loop LP2 is similar to loop LP2'. The same elements have been represented with the same numeral references without a prime. A switch SW11 does within loop LP2 what does switch SW10 within loop LP2'. Loop LP2 involves an absolute minimum airflow limit P2 (on lines 27 and 43), whereas loop LP2' involves an offset limit P2'. The master-controller MST also differs from the one in the cross-referenced patent application in that there is a switch SW8 selecting LP2', or LP2, when controlled into one of two positions defined by a J-K flip-flop FP, depending upon whether:

1) the last inlet valve position (junction J4 of line 3' behind delay DL1, and line 30) has passed the minimum P2 on the way down of the demand to close the inlet valve (comparator OA1 under lines 30, 31 for the K input under input line 33 of the flip-flop FP), thus, in the "downward mode", or 2) whether the last inlet valve position has passed the offset value P2' (comparator OA2 under lines 30 and 32 for the J input under input line 34 of flip-flop FP), thus, in the "upward mode". Furthermore, comparator CMP, which controls switches SW1 and SW2, is made responsive to either a current reference I'min (line 13 and switch SW6 in position 1), or a current reference Imin (line 12'', with switch SW6 in position 2, and a SW7 in position 1), or to a zero current reference (line 73 through switch SW7 in its position 2, with switch SW6 in position 2), the selection being to account for the downward, or the upward mode of operation (from, or to, a closed position for valve BV during BV modulation, namely when BV=0 at junction J5 of control line 4' of the bypass valve BV). Going downward from normal operation, the inlet valve is closing with SW6 in its position 1, so that the threshold for comparator CMP is I'min, as applied on line 13. Therefore, upon a demand for "downward" in the airflow demand, the system will, according the present invention, switch (by SW1 and SW2) under comparator CMP to the bypass modulation mode if the motor current (I) of line 11 equates the value I'min of line 13, this current value corresponding to a preestablished position P2' for the inlet valve which is offset from the absolute minimum position P2 earlier considered in the cross-referenced patent application.

The overall setting and operation of the master-controller is as follows:

Line 1 carries the feedback pressure signal to be compared by subtractor S1 with the assigned setpoint SP of line 2, so as to derive an error which is converted (by the proportional-plus-integral (PI) loop leading, through a summer, to a junction J3) into a demand for correction signal ΔIV appearing at junction J3. The latter represents a demand for a change of airflow to generate through the inlet valve such a flow level, corresponding to (IV+IV), as required to nullify the error between lines 1 and 2. FIG. 2 generally shows the master-controller MST responding to a demand for IV compensation by the amount ΔIV, or ΔBV, appearing on junction J3. From there, line 51' (through loop LP2'), line 51 (through loop LP2), or line 52 (through loop LPV) will cause on lines 3', or line 4', a certain amount of valve modulation, for the corresponding valve (IV or BV). This depends upon which valve is being modulated, according to switches SW1 and SW2. However, as stated earlier, the master-controller of FIG. 2 differs from the master-controller MST of the crossed-referenced patent application. A switch SW8 selects whether control of the inlet valve on line 5 is done with loop LP2' (position 1), or with loop LP2 (position 2). Considering IV modulation (switches SW1 and SW2 on a) under loop LP2' (switch SW8 on 1), the ΔIV compensation requirement of line 51' is added by summer SM1' to the last value of the inlet valve present on line 26' and line 3', after the delay DL1. The new value is derived from SM1' by line 28', and passed onto line 45', then on lines 5 and 3 behind delay DL1.

Under normal operation, when correction has been reached, the airflow from the inlet valve is matching the airflow outputted to the tool, and the tank pressure is kept at the level assigned by the setpoint of line 2, without any discrepancy appearing with the pressure feedback signal of line 1.

Considering downward demand from normal operation with the inlet valve: switches SW1 and SW2 are in position a, and switch SW10, according to the present invention, is in position 1 so that loop LP2' is providing the corrective command from summer SM1' onto line 45' and lines 5 and 3. However, the offset value P2' has been established by loop LP2' which corresponds to an airflow of the inlet valve which is somewhat more than the assigned minimum P2, but such that, when closing toward such value under a sharp demand to lower the demand of airflow, the inlet valve will not go beyond the value P2 which is an absolute limit never to be exceeded in order to avoid a surge. To this effect, the new demand on line 28', as derived at the output of summer SM1' (which is ΔIV+IV), is continuously compared by a comparator CMP1 to the established value P2' (applied on line 43') as a reference. Whenever the threshold P2' is exceeded, CMP1 will cause switch SW10 to leave position 1 and take position 2, whereby lines 45', 5 and 3 will pass to the delay DL1 the value P2' as applied via line 27' to position 2 of the switch. As a result, should a large and quick demand to close valve IV exist at J3 and on line 51', immediately, CMP1 will apply the value P2' onto line 3, thereby preventing any excess from being carried over by line 28' onto line 45'. Accordingly, valve IV will take the position P2', after the delay DL1 will have carried it over, as the last value onto line 3'.

Figure 3A:
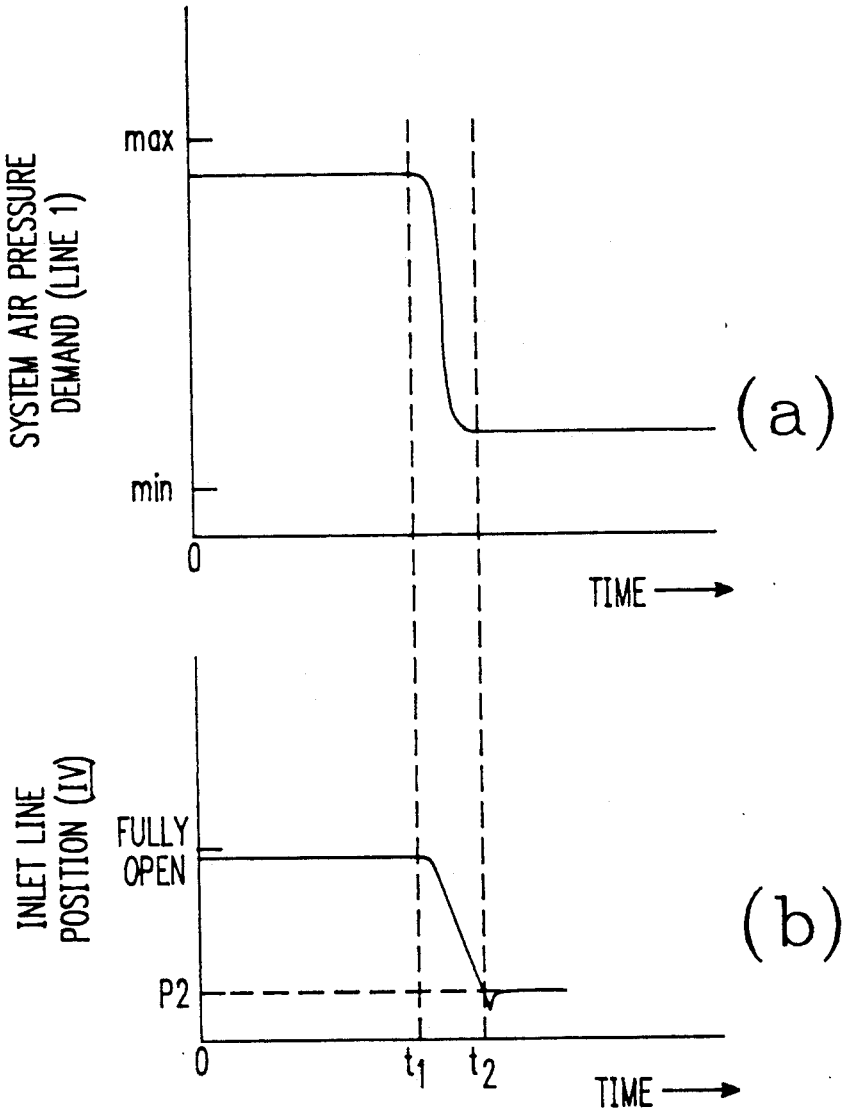
FIGS. 3A and 3B illustrate with curves the operation of the surge avoidance measures which are part of the circuit of FIG. 2.

Referring to FIG. 3A, curves (a) and (b) show what had to be avoided in the case of a sharp demand for closing the inlet valve (curve b) due to a sharp decrease (from instant t1 to instant t2) of the pressure demand of line 1 (curve a). The inlet valve will, then, reach at instant t2 a closed position below P2, the absolute minimum position allowed to avoid a surge.

Figure 3B:
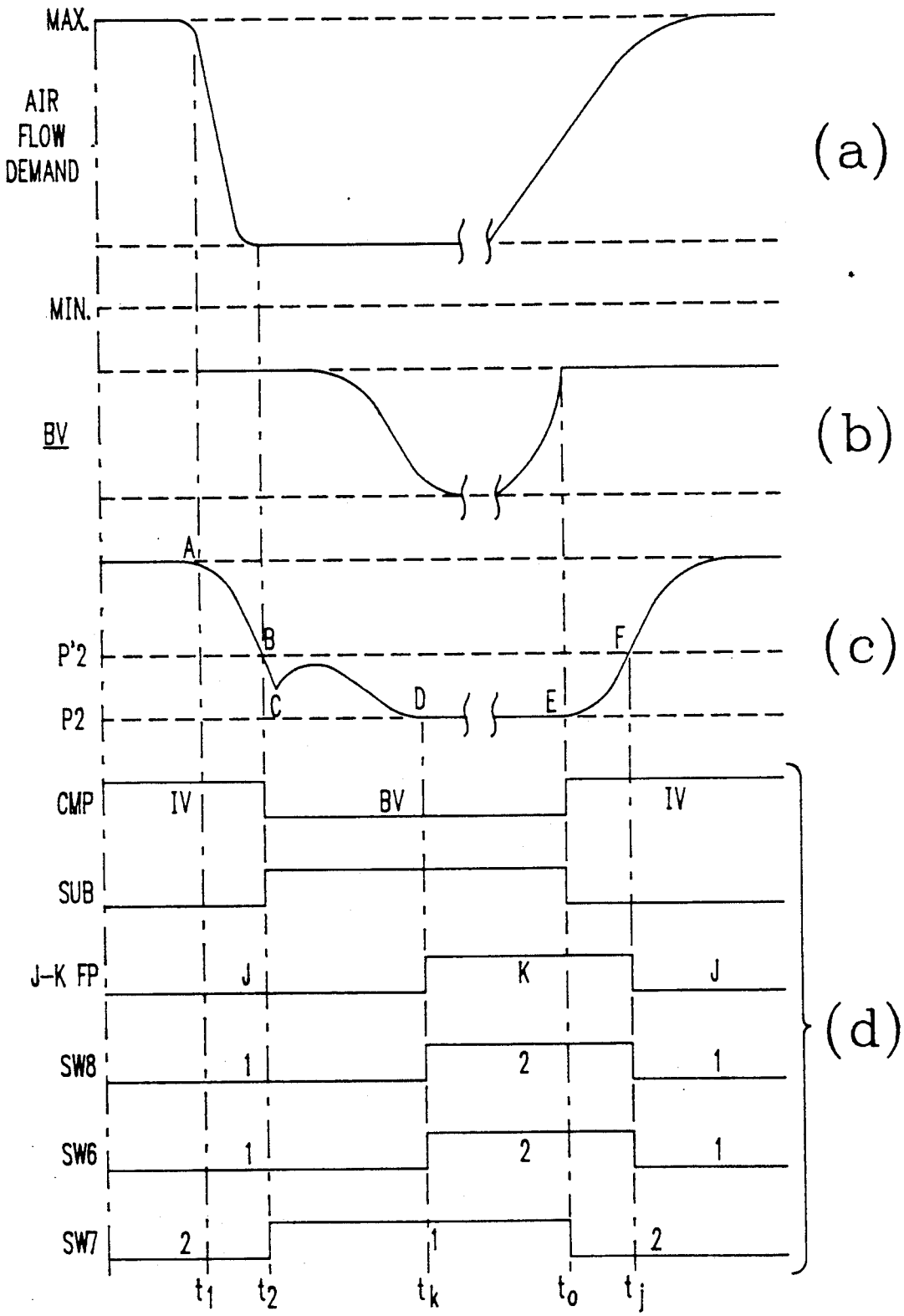
Figure 4:
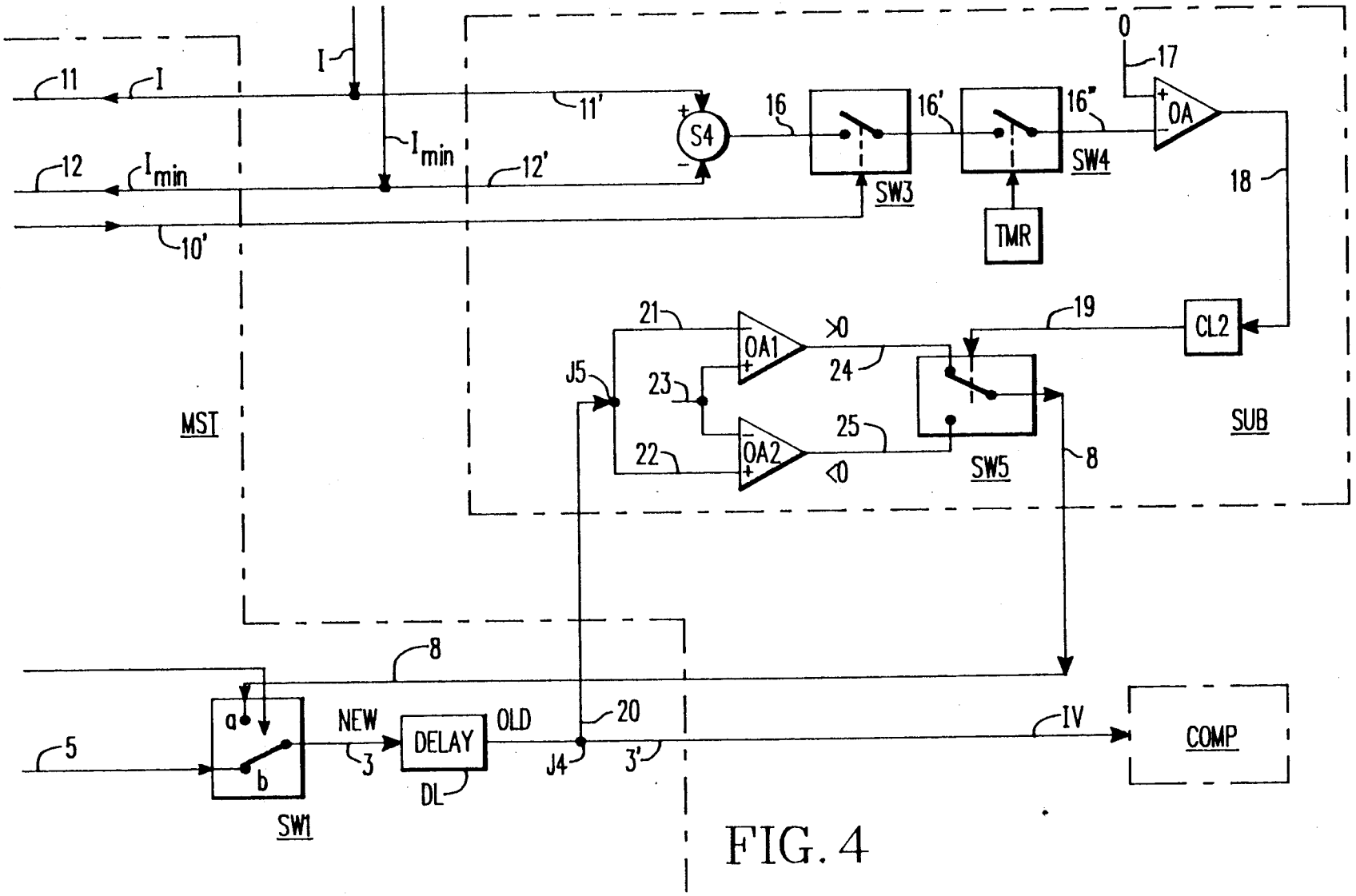
FIG. 4 is specific to the subcontroller used in the system of FIG. 2.

Referring to FIG. 3B, curves (b) and (c) show what happens, with the system of FIG. 2, if such a sharp demand occurs between instants t1 and t2 (curve a). Curve (c) uses a larger scale than in reality for the sake of clarity. Starting with operative point A, the inlet valve position goes down from A to B, which is at the level P2'. When at P2', the motor current (line 11) will reach a value I'min, which is the same as the one applied as a reference by line 13, over switch SW6 (in position 1) and by line 12 into comparator CMP. Therefore, by line 14, coil CL1 and line 10, switches SW1 and SW2 will be triggered to their positions b, instead of a. The result is bypass valve modulation (switch SW2 on line 6), rather than inlet valve modulation (switch SW1 now on line 8 from the subcontroller). FIG. 3B shows as (CMP) under curves (d) the inlet valve modulation IV replaced at time t2 by bypass valve modulation (BV). At the same time, line 10' from line 10 will command a switch SW3 within the subcontroller SUB, thereby enabling the subcontroller to correct by line 8 the inlet valve position if it deviates from P2 (line 12'). This is shown as (SUB) among the curves under (d) in FIG. 3B. In the meantime, subcontroller will cause the inlet valve position to be reduced, after instant t2. The inlet valve could somewhat exceed the limit P2', but, if the offset of P2' relative to P2 has been properly ascertained, such lowering beyond instant t2 (shown at C) will remain less than P2, and there will be no risk of a surge. From instant t2, the subcontroller will operate, during bypass valve modulation (SW1, and SW2 in position b), so as to bring the inlet valve to position P2, after some tendency to reach P2' in the process, as shown by curve (c). The subcontroller used is shown illustratively in FIG. 4. It performs the operation of bringing the inlet valve position of line 3' to the level P2. FIG. 4 is like the one used in the copending patent application. Lines 11' and 12' carrying the value of the motor current I and of the reference Imin, respectively, lead to a subtractor S4 which on line 16 shows a deviation from P2 until I has become equal to Imin. At the moment that the comparator CMP has changed the modulation from IV to BV (switches SW1 and SW2 to position b), lines 10 and 10' have closed switch SW3, thus enabling operation of the SUB. Timer TMR will intermittently close a switch SW4 for a period of testing whether there is a deviation above, or below, zero (comparator OA responsive to line 16'' for a deviation derived from line 16, and to line 17 for a zero reference). The sign of the output on line 18 will determine through coil CL2 whether the bidirectional circuit BIC shall increment, or decrement from, the last value of the inlet valve position at junction J4 and on line 20 to junction J5. Depending upon the positive loop (line 21, comparator OA1 and line 24) or the negative loop (line 22, comparator OA2 and line 25), a delta value is applied by line 23 which is added to, or subtracted from, the J5 magnitude. As a result, on line 8 will appear an increasing or decreasing value, transmitted as a correction upon line 3 and behind delay DL1. Indeed, from P'2 to P2, the deviation is such that the decreasing loop is operative and, as shown by curve (c) of FIG. 4B, the inlet valve last position of line 3' will go progressively to the level P2. Having explained the operation from operative point B to operative point D, it is now assumed that in the meantime and eventually the bypass valve (controlled by its loop LBV including line 46 (BV) to summer SM2 which also receives (ΔBV) line 52 from junction J3) will have reached the fully opened position. Should the demand (curve (a)) now call for an increase of the airflow, the bypass valve is, then, called by line 4' to close (curve (b). When BV reaches the closed position (BV=0), line 40 (from junction J5) and line 70 (from line 7 and reference zero) will, via comparator 60 and line 41 cause coil CL3 and line 42 to shift switch SW7 to position 2. As a result, comparator CMP will receive zero as a reference, from lines 72 and 12. This will bring coil CL1 to shift SW1 and SW2 back to position a. Now, the system is under inlet valve modulation. This means that from E to F (curve (c) of FIG. 3B) loop LP2 is operative to limit any demand downward from junction J3 to the absolute limit P2 of lines 43 and 27, through comparator CMP2 and switch SW11. Once, at instant tj (position F), the J-K flip-flop will be triggered (since P2' has been reached on line 30) to reset (by line 35, coil CL2 and line 36) the switch SW8, thus, enabling again loop LP2'.

From F on, toward normal inlet valve operation, the system is now restored with initial conditions insuring an offset limit P2' in case of another sharp downward demand.

Figure 5:
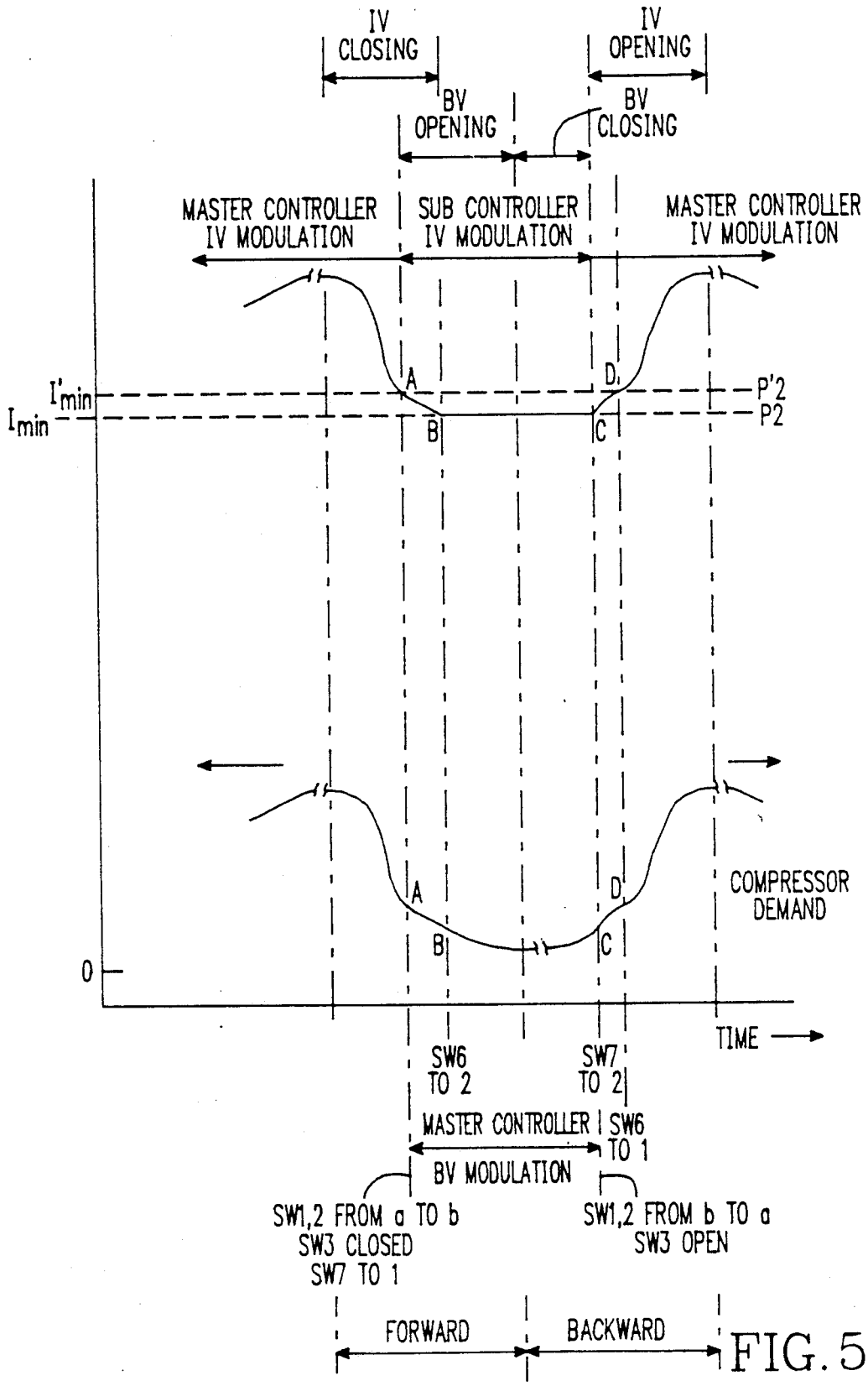
FIG. 5 illustrates with curves the overall operation of the master-controller upon the successive occurrence of a sharp downward demand followed by a return upward to normal operation of the compressor system of FIG. 1.

FIG. 5 illustrates the successive modes of operation involved upon a fall of the airflow demand (downward) followed by a return to normal operation (upward). The steps are as follows:

Until operative point A

The Inlet Valve is closing under LP2' (SW8 in position 1) until position P2' is reached (SW6 in position 1).

At operative point A

Switches SW1 and SW2 go to position b (BV modulation follows)

Switch SW3 goes to position 2 (enabling SUB)

Switch SW7 goes to position (Imin on line 112'')

From A to B

SUB under Imin is bringing IV down from P2' to P2

At operative point B

Switch SW8 goes to position (ready for LP2 operation)

Switch SW6 goes to position 2 (ready for when I=O)

At operative point C

Switch 7 to position 2 (causing SW1 and SW2 to go to position 1)

SW3 disables SUB

From C to D

LP2 operation under limit P2

At operative point D

SW8 returns to position 1

SW6 returns to position 1 (I'min on line 13)

IV modulation under LP2'

Figure 6:
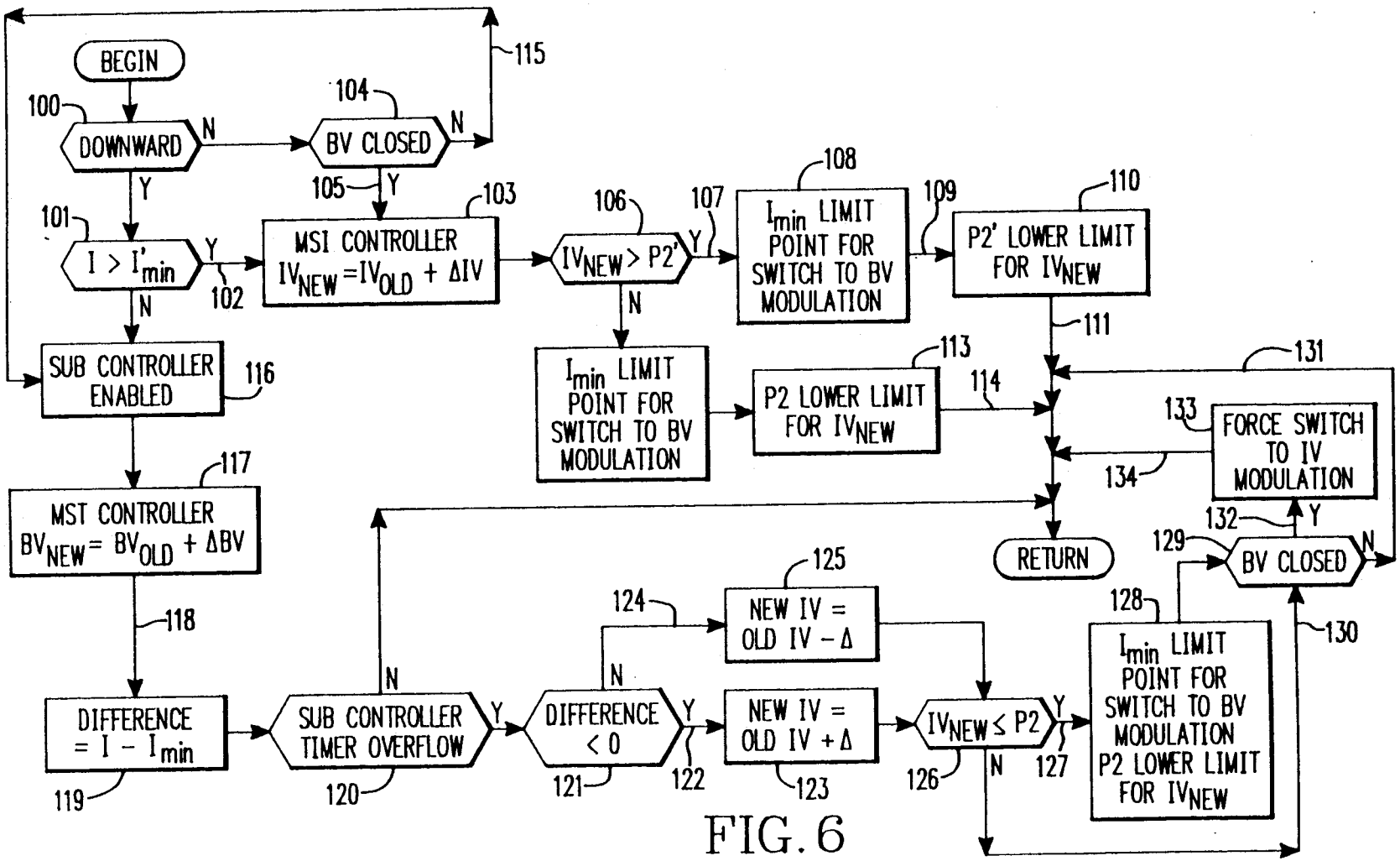
FIG. 6 is a flow chart illustrating the operative steps used in a computer implementation of the computer system of FIG. 2.

Referring to the flow chart of FIG. 6, the system (master-controller and subcontroller SUB) is implemented with a microcomputer, typically an INTEL 8031, the steps being as follows:

At 100 is determined whether the system is operating from normal IV modulation in the downward direction. If the answer is YES, at 101 the question is whether the motor current I is larger than the offset limit I'min (I>I'min). If the answer is YES, by 102 the system goes to 103 where the master-controller establishes IVnew=IVold+ΔIV. Then, at 106 the question is: whether IVnew>P2'? Should the answer be YES, by 107 the system goes to 108 where I'min is set as a limit to switch to BV modulation. Then, by 109, at 110 P2' is set as the lower limit for IVnew. After that, there is a Return by line 111. If, however, at 106 the answer is NO, at 112 Imin is set as the limit for switching to BV modulation. Then, at 113, P2 is set as the lower limit for IVnew, and by line 114 there is a Return.

If at 100 the conclusion is NO, the next question is at 104 whether BV is closed. If it is, this means that the system operation is in the upward direction. Therefore, by line 105 the system goes to 106, as before, with the ensuing choices. If at 104 the answer is NO, by 115 the system goes to 116. 116 is also the next step from 101 if the answer there is that I<I'min. At 116 the subcontroller SUB is enabled. Then, at 117, the master-controller (operating under BV modulation) establishes BVnew=BVold+ΔBV. After that, by 118, at 119 is established the difference (I−Imin) showing whether there is a deviation to be corrected by the subcontroller. The timer is tested for overflow at 120. If NO, there will be a Return. If YES at 120, at 121 is ascertained whether the difference is positive or negative. If positive, by 122 at 123 is established the corrected value IVnew=IVold+delta, where delta is an increment. If the difference at 121 is negative, by 124 will be established at 125 IVnew=IVold−delta, where delta is a decrement. From either 123 or 125, the system goes to 126 where is ascertained: whether IVnew is equal or larger than P2? If NO by 130 the system goes to 129 where is determined whether BV is closed. If NOT, there is a Return by 131. If YES at 129, by line 132 the system goes to 133 where there is a shift from IV to BV modulation. If at 126 the answer is YES, by line 127 the system goes to 128 where Imin is set as the limit to switch to BV modulation, and P2 is set as the limit for IVnew. After that, the system goes to 129 with the corresponding options.

A LISTING, illustrating the operative steps of the microprocessor within the compressor control system according to the present invention, follows in the APPENDIX.

```
$TITLE(IR Compressor Controller --> Proportional & Integral Control)
$DEBUG
$XREF
$eject

NAME   pi_Control

            ;THIS CODE IS EXECUTED EVERY 100 MILLISECONDS.  IT CONTROLS
            ;THE POSITIONING OF THE INLET AND BLOWOFF VALVES.

            ;THE INLET VALVE IS CONTROLLED BY THE INLET DAC.  A FULLY
            ;OPEN INLET VALVE CORRESPONDS TO AN INLET DAC INPUT
            ;OF 11 1111 1111B.  A FULLY CLOSED INLET VALVE CORRESPONDS
            ;TO AN INLET DAC INPUT OF 00 0000 0000B.

            ;THE BLOWOFF VALVE IS CONTROLLED BY THE BLOWOFF DAC.  A FULLY
            ;OPEN BLOWOFF VALVE CORRESPONDS TO A BLOWOFF DAC INPUT
            ;OF 00 0000 0000B.  A FULLY CLOSED BLOWOFF VALVE CORRESPONDS
            ;TO A BLOWOFF DAC INPUT OF 11 1111 1111B.

      ;RAW DATA FROM FRONT PANEL RESIDING IN EXTERNAL RAM:
            ;P1H, L          INLET VALVE P1 POSITION. RANGE 15 TO 30.
            ;PBH, L          PROPORTIONAL BAND. RANGE 1 TO 200.
            ;KIH, L          INTEGRAL GAIN. RANGE 5 TO 2000.
            ;IMINH, L        MINIMUM MOTOR-CURRENT. RANGE 0 TO 9999.
            ;IMAXH, L        MAXIMUM MOTOR CURRENT. RANGE 0 TO 9999.
            ;RAMP_TIME       LOADING RAMP TIME OF BLOWOFF.  RANGE 5 TO 15.
```

```
        ;RELOAD_PCH, L    RELOAD PERCENT IN AUTO-DUAL. RANGE 75 TO 95.
        ;CTRH, L          CURRENT XFORMER RATIO. RANGE 50 TO 1000.
        ;INCOM_FP_PSPH, L        PRESSURE SET POINT. RANGE 0 TO 500.

;EXTERNAL RAM DATA NEEDED FOR THIS MODULE NOT FROM FRONT PANEL:
        ;IMOTH, L         MOTOR CURRENT.
        ;SAPH, L          SYSTEM AIR PRESSURE (FEEDBACK SIGNAL).

;EXTERNAL RAM BITES GENERATED BY THIS MODULE:
        ;P1POSH,L         COMPUTED P1 POSITION FOR INLET DAC.
        ;KPH, L           COMPUTED PROPORTIONAL GAIN.
        ;KIKPH, L         COMPUTED PRODUCT OF KI AND KP.
        ;L                EXPONENT OF KIKP.
        ;IMINHYSTH, L     MINIMUM MOTOR CURRENT HISTERESIS VALUE.
        ;RAMP_STEP        COMPUTED STEP VALUE DURING LOAD RAMPING.
        ;ADLDVALH, L      COMPUTED RELOAD PERCENT IN AUTO-DUAL.
        ;PSPH, L          COMPUTED PRESSURE SET POINT.
        ;E0,E1,E2,E3      PREVIOUS ERROR SIGNAL (FOR TRAPEZOIDAL INT).

Compressor Controller --> Proportional & Integral Control


      PUBLIC   pi_control, prop_plus_int


      EXTRN       BIT  (PSATFLG, NSATFLG, TBIT, INTENAFLG)

      EXTRN      CODE  (fetch_r45, rset_integrator, x_to_i, i_to_x, mult4x1)
      EXTRN      CODE  (TWOSC, Double_MULTI, ADDH, IRAMRESET, fetch_r01)
      EXTRN      CODE  (adjust, fast_shift, fetch_ba)

      EXTRN      DATA  (SUM0, SUM1, SUM2, SUM3, TEMP0, TEMP1, TEMP2, TEMP3)
      EXTRN      DATA  (XL, XH, PROPH, PROPL, INTH, INTL, TEMP7, TEMP6)

      EXTRN     XDATA  (pspl, e0, CSAPL, kpl, kikpl, l)


 CONTROLler_PI   SEGMENT  CODE    UNIT
      RSEG       CONTROLler_PI

      ;THIS ROUTINE IMPLIMENTS THE PI CONTROLLER
      ;        DO PROPORTIONAL CONTROL BLOCK FIRST.

      ;        1. COMPUTE ERROR SIGNAL, E.  --
      ;        2. RELCALL PROPORTIONAL GAIN, KPH,L.
      ;        3. MULTIPLY E*KP. 4 BITE MAX.
      ;        4. DIVIDE RESULT BY 256.
      ;        5. LIMIT 4. TO +,- 2047.
      ;        7. STORE RESULT IN PROPH,L A SIGNED NUMBER.

 PI_CONTROL:            MOV     DPTR, #CSAPL
      call     fetch_ba                  ;a,b = csapl
                        XCH     A, B

                        LCALL   TWOSC             ;GET 2'S COMP OF SYS AIR PR.
                        MOV     7D, B             ;MOVE TO R7,6.
                        MOV     R6, A

                        MOV     DPTR, #PSPL
```

```
        call    fetch_ba                ;a,b = psp1
                        XCH     A, B            ; B,A = PSPH,L.

;       DO R3,R2 = PSPH,L - SAPH,L. CONVERT TO AN UNSIGNED TWO BYTE NUMBER
;       BY STORING SIGN IN TBIT.  THEN MULTIPLY ERROR BY KP USING Double_MULTI.
;       CHANGE BACK TO A TWO BYTE SIGNED NUMBER, LIMITING RESULT TO +,- 2047,
;       AND LOADING PROPH, L WITH IT.

                        ADD     A, R6           ; DO PSPH,L - SAPH,L.
                        MOV     R6, A
                        MOV     A, B
                        ADDC    A, R7
                        MOV     R7, A           ; R7,R6=PSP-SAP, A SIGNED NUMB.
                        CLR     TBIT
                        JNB     ACC.7, NOT_NEG

                        MOV     B, R7
                        MOV     A, R6
                        LCALL   TWOSC
                        SETB    TBIT            ; TBIT=1 IF NEGATIVE.
                        MOV     R3, B
                        MOV     R2, A
                        sJMP    MULT_KP

NOT_NEG:                MOV     R3, 7D
                        MOV     R2, 6D          ; R3,R2=UNSIGNED PSP-SAP.

MULT_KP:                MOV     DPTR, #KPL      ; GET KP
        call    fetch_r01                       ;r1,0 = kpl

                        LCALL   Double_MULTI    ; DO E*KP. DIVIDE BY 256.
                                                ; RESULT IN R7-R5.
;       MAKE E*KP A TWO BYTE SIGNED NUMBER
;       AND PLACE IN PROPH,L.  LIMIT RESULT
;       TO +,- 2047.
                        MOV     A, R7           ; > +,-2047 ?
                        JNZ     LIMIT1
                        MOV     A, R6
                        ANL     A, #11111000B
                        JNZ     LIMIT1

                        JB      TBIT, COMP1     ;PUT SIGNED NUM IN PROP.
                        MOV     PROPH, R6
                        MOV     PROPL, R5
                        sJMP    INTEGRATE
COMP1:                  MOV     B, R6
                        MOV     A, R5
                        LCALL   TWOSC
                        MOV     PROPH, B
                        MOV     PROPL, A
                        sJMP    INTEGRATE

;       TO GET HERE, E*KP > 2047 OR E*KP < -2047.

LIMIT1:                         JB      TBIT, LIM_NEG
                        MOV     PROPH, #07H
                        MOV     PROPL, #0FFH            ; PROP = 2047.
                        sJMP    INTEGRATE
```

```
LIM_NEG:            MOV     PROPH, #0F8H
                    MOV     PROPL, #01H             ; PROP = -2047.

;     NOW DO THE INTEGRAL CONTROL BLOCK.

INTEGRATE:          JB      INTENAFLG, CONT_INT     ; NO INTEGRAL CONTROL
      call    rset_integrator                       ;  IF INTENAFLG=0
                    LJMP    PROP_PLUS_INT

;     COMPUTE A FOUR BITE SIGNED NUMBER THAT IS THE DIFFERENCE BETWEEN
;     THE PRESSURE SETPOINT AND THE SYSTEM AIR PRESSURE.  EACH NUMBER
;     REPRESENTS TWO BITS/PSI OF PRESSURE.   EACH NUMBER HAS A MAX
;     VALUE OF 1023.  THE MAX DIFFERENCE IS +,-1023.

CONT_INT:           MOV     DPTR, #CSAPL    ; GET SYSTEM AIR PRESSURE.
      call    fetch_r45                       ;r5,4 = csap
                    MOV     R7, #0FFH
                    MOV     R6, #0FFH
                    MOV     A, R5
                    CPL     A
                    MOV     R5, A
                    MOV     A, R4
                    CPL     A
                    ADD     A, #1D
                    MOV     R4, A
                    MOV     R0, #5D
                    MOV     R1, #3D
COMP_LOOP:          MOV     A, @R0

                    ADDC    A, #0D
                    MOV     @R0, A
                    INC     R0
                    DJNZ    R1, COMP_LOOP   ;THE NEGATIVE 2'S COMP OF
                                            ; SAPH,L IS IN R7-R4.
                    MOV     DPTR, #PSPL
                    MOVX    A, @DPTR
                    MOV     TEMP0, A
                    INC     DPTR
                    MOVX    A, @DPTR
                    MOV     TEMP1, A
                    MOV     TEMP2, #0D
                    MOV     TEMP3, #0D      ;TEMP3-0=0,0,PSPH,PSPL.

                    MOV     R0, #TEMP0
                    MOV     R1, #4D
                    MOV     R2, #4D         ;DO PSP-SAP=ERROR.
                    LCALL   ADDN            ; RESULT IN TEMP3-TEMP0.

;     THE ERROR, A FOUR BYTE SIGNED NUMBER, IS NOW IN TEMP3-TEMP0.

;     IF ERROR IS POSITIVE AND PSATFLG IS SET (INDICATING THE INTEGRATOR
;     HAS INTEGRATED UP TO > 2047), DO THE FOLLOWING;
;             1. LOAD 0 INTO PAST ERROR REGISTERS ( E(K-1) ), E4-E0.
;             2. LOAD INTH,L WITH 2047
;             3. DO NOT CHANGE SUM
;             4. JUMP TO ADDITION OF PROPORTIONAL AND INTEGRAL OUTPUTS.

;     IF ERROR IS NEGATIVE AND NSATFLG IS SET (INDICATING THE INTEGRATOR HAS
;     INTEGRATED DOWN TO 0), DO THE FOLLOWING;
```

```
;           1. LOAD 0 INTO PAST ERROR REGISTERS, E4-E0.
;           2. LOAD INTH,L WITH 0.
;           3. LOAD SUM WITH 0
;           4. JUMP TO ADDITION OF PROPORTIONAL AND INTEGRAL OUTPUTS.

;     OTHERWISE, DO THE FOLLOWING;
;           1. CLEAR PSATFLG AND NSATFLG.
;           2. ADD PRESENT ERROR WITH PAST ERROR.
;           3. MOVE THE PRESENT ERROR INTO PAST ERROR.
;           4. ADD RESULT IN 2 TO THE INTEGRATOR SUMMING REGISTERS,
;              SUM3-SUM0.

                    MOV     A, TEMP3
                    MOV     C, ACC.7          ; C=SIGN BIT.
                    JC      EX_NSAT
                    JNB     PSATFLG, DO_SUM
                    MOV     DPTR, #E0                 ; E>0 AND PSATFLG=1.
                    MOV     R0, #4D
                    LCALL   XRAMRESET
                    MOV     INTH, #07H
                    MOV     INTL, #0FFH
                    LJMP    PROP_PLUS_INT

EX_NSAT:            JNB     NSATFLG, DO_SUM           ; E<0 AND NSATFLG=1
                    MOV     DPTR, #E0
                    MOV     R0, #4D

                    LCALL   XRAMRESET
     call     rset_integrator
                    LJMP    PROP_PLUS_INT

DO_SUM:                     CLR     PSATFLG
                    CLR     NSATFLG

                    MOV     DPTR, #E0         ; GET PAST ERROR, E(N-1).
                    MOV     R0, #4D
                    MOV     R1, #4D
                    LCALL   X_TO_I            ; R7-R4=E(N-1).
                    MOV     R0, #4D           ; ADD PRESENT AND PAST ERROR.
                    MOV     R1, #TEMP0
                    MOV     R2, #4D
                    LCALL   ADDN              ; R7-R4=E(N)+E(N-1).

                    MOV     DPTR, #E0
                    MOV     R0, #TEMP0
                    MOV     R1, #4D
                    LCALL   I_TO_X            ; E(N-1) <- E(N).

                    MOV     R0, #SUM0
                    MOV     R1, #4D
                    MOV     R2, #4D
                    LCALL   ADDN              ; SUM = SUM + [E(N)+E(N-1)].
                                              ; MAX=2E85D17E.
;     IF SUM IS < 0, DO THE FOLLOWING. OTHERWISE CONTINUE.
;           1. E(N-1)=0
;           2. MAKE SUM 0.
;           3. SET NSATFLG.
;           4. INTH,L=0.
;           5. JUMP TO PROP_PLUS_INT
```

```
                MOV     A, SUM3
                MOV     C, ACC.7; C= SIGN BIT OF SUM.
                JNC     MULT_55         ; IS SUM < 0 ?

                SETB    NSATFLG         ; SUM < 0.
                MOV     DPTR, #E0
                MOV     R0, #4D
                LCALL   XRAMRESET
     call     rset_integrator
                SJMP    PROP_PLUS_INT

;     NOW MULTIPLY SUM BY 2**16(DELTA_T/2)=55.  DELTA_T IS THE SAMPLING TIME
;     IN MINUTES. DELTA_T=0.00167# MIN. A FOUR BYTE MAX NUMBER.
;     55D*2E85D17H = 9FEBFFF1H.
;     THIS REPRESENTS 2**16*INTEGRAL[ E(T)DT ].

MULT_55:        MOV     R3, SUM0
                MOV     R4, SUM1
                MOV     R5, SUM2
                MOV     R6, SUM3
                MOV     R2, #55D
                LCALL   MULT4X1         ; 55*SUM IN R6-R3. MAX NUMBER
                                        ; IS 9FEBFFF1H
;     CONVERT 55*SUM TO AN EQUIVALENT 2 BYTE NUMBER WITH A 2**K MULTIPLIER.
;     STORE TWO BYTE NUMBER IN R7, R6. STORE K IN TEMP7.

                MOV     R7, 6D
                MOV     R6, 5D
                MOV     R5, 4D
                MOV     R4, 3D
                LCALL   ADJUST
                MOV     TEMP7, R3

;     MULTIPLY 55*SUM IN R7, R6 BY KIKP.

                MOV     R3, 7D
                MOV     R2, 6D          ; R3,R2=55*SUM
                MOV     DPTR, #KIKPL
     call     fetch_r01                  ;r1,0 = kikpl
                LCALL   Double_MULTI

;     ADJUST FOUR BYTE NUMBER TO A TWO BYTE NUMBER WITH A 2**M MULTIPLIER.
;     PLACE THE TWO BYTE NUMBER IN R7, R6 AND PLACE M IN TEMP6.

                LCALL   ADJUST
                MOV     TEMP6, R3

;     MULTIPLY R7, R6 BY (2**16)/100 = 655D SINCE KI IS 100 TIMES TOO BIG.

                MOV     R3, 7D
                MOV     R2, 6D
                MOV     R1, #02H
                MOV     R0, #8FH
                LCALL   Double_MULTI

;     R7-R4 CONTAINS KI*KP*INT[E(T)DT]*2**[40-(K+L+M)]
;     ELIMINATE EXPONENT BY SHIFTING.
;     (K+L+M) IS ALWAYS <,= 40.
```

```
                MOV     DPTR, #L
                MOVX    A, @DPTR
                ADD     A, TEMP7
                ADD     A, TEMP6        ; A=K+L+M.
                CLR     C
                MOV     B, A
                MOV     A, #40D
                SUBB    A, B
                JZ      NO_SHIFT        ; A=40-(K+L+M)
                LCALL   FAST_SHIFT

;       LIMIT TO 2047.

NO_SHIFT:       MOV     INTL, R4
                MOV     INTH, R5
                MOV     A, R7
                JNZ     LIMIT_INT
                MOV     A, R6
                JNZ     LIMIT_INT

                MOV     A, R5
                ANL     A, #11111000B
                JZ      PROP_PLUS_INT

LIMIT_INT:      SETB    PSATFLG
                MOV     INTL, #0FFH
                MOV     INTH, #07H

;       ADD THE PROPORTIONAL OUTPUT, PROPH,L PLUS THE INTEGRAL OUTPUT, INTH,L.
;       PROPH,L IS A SIGNED NUMBER LIMITED TO +,- 2047.  INTH,L IS A POSITIVE
;       NUMBER LIMITED TO 0 -> 2047. LIMIT THE SUM TO 0 -> 2047.  PUT RESULT
;       IN MH,L THE PI CONTROLLER OUTPUT.

PROP_PLUS_INT:  MOV     A, INTL
                ADD     A, PROPL
                MOV     ML, A
                MOV     A, INTH
                ADDC    A, PROPH
                MOV     MH, A
                JNB     ACC.7, GT2047?  ; IS MH,L NEGATIVE?

                MOV     MH, #0D         ; MH,L IS NEGATIVE.
                MOV     ML, #0D         ; MAKE IT 0.
                JMP     END_PI

GT2047?:        MOV     A, MH           ; MH,L IS POSITIVE.
                ANL     A, #11111000B   ; IF M > 2047, M=2047.
                JZ      END_PI
                MOV     MH, #07H
                MOV     ML, #0FFH

END_PI:         RET

                END
```

What is claimed is:

1. In a compressor control system including:

a. a master-controller operative in one of an inlet valve modulation mode and a bypass valve modulation mode for controlling an inlet valve and a bypass valve of a compressor, respectively; the compressor supplying fluid flow to a load, the master-controller being operative in response to a signal representative of the load pressure and to a setpoint signal; and b. a subcontroller operative during bypass valve modulation and responsive to a present inlet valve position for incrementing the same in relation to a deviation of the present inlet valve position from a predetermined minimum inlet valve position P2 to restore said predetermined minimum inlet valve position as the present inlet valve position; the combination of:

first means associated with the master-controller for modulating the inlet valve; first limiter means being associated with said first modulating means for limiting the operation downward thereof to a position P2′ larger than said P2 position by a predetermined amount;

second means associated with the master-controller for modulating the inlet valve; second limiter means being associated with said second modulating means for limiting the operation downward thereof to said P2 position; and means for selecting one of said first and second modulating means upon the P2 position being reached as the present position in the downward direction for said second modulating means and upon the P2′ position being reached as the present position in the upward direction for said first modulating means.

2. The system of claim 1, with the master-controller selecting the bypass valve modulation mode and the subcontroller being enabled upon the inlet valve reaching said P2′ position in the downward direction; whereby the subcontroller brings the inlet valve position from the P2′ to the P2 position during bypass valve modulation in the downward direction.

3. The system of claim 2, with the master-controller selecting the inlet valve modulation and the subcontroller being disabled upon the bypass valve reaching a closed position as the present position in the upward direction.

4. The system of claim 3, with the compressor being driven by an electric motor at constant speed, a motor current signal being derived as an indication of inlet valve position, master-controller selecting means and subcontroller enabling means being provided operative in relation to said motor current signal, one to initiate bypass valve modulation by the master-controller, the other to enable the subcontroller, in the downward direction and upon the motor current becoming equal to a value characteristic of said P2′ inlet valve position.

5. The system of claim 4, with the subcontroller being operable in relation to a value of the motor current characteristic of said P2 position.

6. The system of claim 5, with said second means and said second limiter means being operative during inlet valve modulation in the upward direction from a present inlet valve position equal to P2 to a present inlet valve position equal to P2′.

7. The system of claim 6, with said first means and said first limiter means being operative during inlet valve modulation in the downward direction from a present valve position larger than P2′ down to P2′.

* * * * *